United States Patent [19]

Bell et al.

[11] Patent Number: 4,745,972

[45] Date of Patent: May 24, 1988

[54] WELL PACKER HAVING EXTRUSION PREVENTING RINGS

[75] Inventors: Merle L. Bell, New Waverly; Martin P. Coronado, Huntsville, both of Tex.

[73] Assignee: Hughes Tool Company, Houston, Tex.

[21] Appl. No.: 60,564

[22] Filed: Jun. 10, 1987

[51] Int. Cl.[4] ..... E21B 33/128

[52] U.S. Cl. ..... 166/134; 166/138; 166/196; 277/116.2

[58] Field of Search ..... 166/134, 118, 138, 140, 166/216, 217, 181, 182, 123, 135, 179, 192, 196; 277/116.2

[56] References Cited

U.S. PATENT DOCUMENTS

| | | | |
|---|---|---|---|
| Re. 31,978 | 9/1985 | McStravick | 166/387 |
| 2,921,632 | 1/1960 | Clark | 166/204 |
| 2,921,633 | 1/1960 | Baker | 166/204 |
| 3,036,639 | 5/1962 | Baker | 166/201 |
| 3,061,013 | 10/1962 | Thomas | 166/204 |
| 3,109,493 | 11/1963 | Carter | 166/204 |
| 3,229,767 | 1/1966 | Urbanosky | 166/134 |
| 4,433,726 | 2/1984 | Preston, Jr. et al. | 166/118 |
| 4,611,658 | 9/1986 | Salerni et al. | 166/134 |
| 4,688,634 | 8/1987 | Lustig et al. | 166/181 |

*Primary Examiner*—James A. Leppink
*Assistant Examiner*—Terry Lee Melius
*Attorney, Agent, or Firm*—Charles D. Gunter, Jr.

[57] ABSTRACT

A well packer is shown having an annular packing element surrounded on either side by axially shiftable annular shoulders. Extrusion preventing devices are located between each shoulder and the packing element to prevent extrusion of the packing material during use. The extrusion preventing devices include an outer split ring having a generally triangular cross-section defined by a cylindrical abutment surface for abutment with the outer conduit, a tapered sidewall engageable with one of the shoulders, and a planar surface which is substantially normal to the longitudinal axis of the packer. The planar surface has an innermost radial extent which joins the tapered sidewall and an outermost radial extent which joins the cylindrical abutment surface. The extrusion preventing device also includes an inner split ring of complimentary shape but reversely arranged to the outer ring. The planar surface of the inner ring is provided with a circumferential land which joins the innermost radial extent for engaging the innermost radial extent of the outer ring to prevent extrusion of the packing element past the extrusion preventing device.

6 Claims, 2 Drawing Sheets

FIG. 2
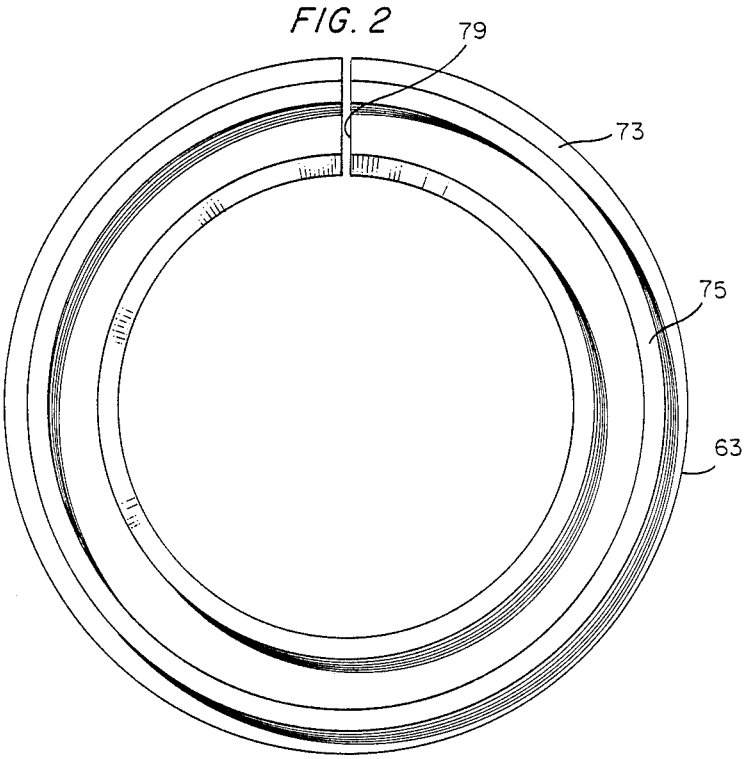
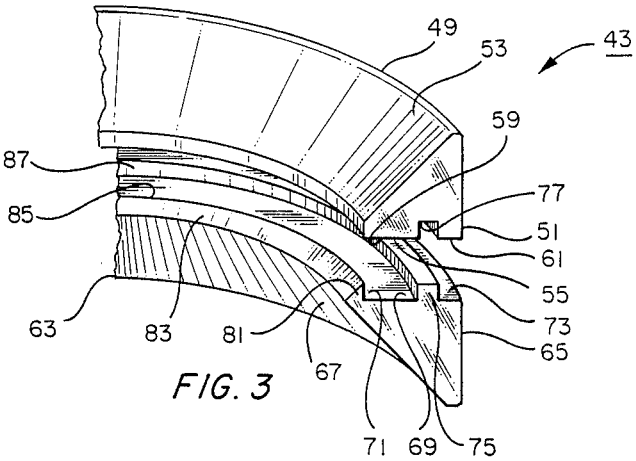
FIG. 3

WELL PACKER HAVING EXTRUSION PREVENTING RINGS

BACKGROUND OF THE INVENTION

1. Field of the Invention

The present invention relates to well tools used in subterranean oil and gas wells under elevated conditions of temperature and pressure and, specifically, to the packing element systems employed on such well tools.

2. Description of the Prior Art

Downhole well tools of the type under consideration are used to maintain sealing integrity between inner and outer concentric conduits in subterranean wells. For instance, downhole well packers are commonly used to establish a seal in the annulus between the well casing and a smaller diameter production tubing string inserted into the casing. Permanent well packers can be set at a desired location within the well bore by means of mechanical tubing or wireline manipulation or by the use of hydraulic pressure. Once the permanent packer has been set at the prescribed location within the well, it can only be removed by milling or drilling the packer. Retrievable packers can be set by hydraulic or mechanical manipulation but can later be retrieved to the well surface.

Permanent packers are typically utilized at higher temperatures and pressures than comparable retrievable packers. Both permanent and retrievable packers are normally inserted within a well bore with adequate clearance between the packer and the well bore to avoid interference during installation. When the packer is set, radially expandable slips are actuated and move into engagement with the well casing. An annular seal or packing element, which is typically formed of a resilient, elastomeric material, is carried about a tubular mandrel and is expanded into engagement with the well casing in response to axial compression exerted on the packing element. The clearance between the packer mandrel and the expander surfaces and between the packer mandrel and the well casing provides an annular area into which the packing element, subjected to axial compression, can extrude.

In order to resist extrusion, permanent packers typically employ retaining or backup rings formed of a malleable metallic material. These rings are expandable into engagement with the casing upon the application of an axially compressive force sufficient to expand the packing element into the sealing engagement with the casing. The purpose of these rings is to seal off the annular clearance area to prevent extrusion of the packing material under extreme temperature and pressure conditions.

U.S. Pat. No. 3,109.493, issued Nov. 5, 1963, to Carter, shows a typical prior art retaining ring design. Although such extrusion preventing rings were effective in improving packer performance under extreme temperature and pressure conditions, several deficiencies continued to exist. Certain of the ring designs proved to be weak and would bend and fail under high loading. Other of the prior art ring designs allowed some flowing or extrusion of the packing material through the annular clearance between the ring and mandrel of the packer.

An object of the present invention is to provide a well packer having an improved extrusion preventing ring design which resists bending and deformation under extreme conditions of temperature and pressure.

Another object of the invention is to provide an improved ring design which more effectively fills the annular space between the packer mandrel and the well casing than did prior designs.

Additional objects, features and advantages will be apparent in the written description which follows.

SUMMARY OF THE INVENTION

The well packer of the invention is used to maintain sealing integrity between inner and outer concentric conduits under downhole temperature and pressure conditions in a subterranean well. The packer includes an annular packing element which is radially expandable under axial compression. Upper and lower annular shoulders are disposed on opposite sides of the packing element and at least one of the shoulders is movable axially towards and away from the other shoulder. An extrusion preventing device is located between each shoulder and the packing element.

The extrusion preventing device includes an outer spilt ring having a generally triangular cross-section defined by a cylindrical abutment surface for abutment with the inner surface of the outer conduit, a tapered sidewall engageable with one of the shoulders, and a planar surface which substantially normal to the longitudinal axis of the packer. The planar surface has an innermost radial extent which joins the tapered sidewall and an outermost radial extent which joins the cylindrical abutment surface. The extrusion preventing device also includes an inner split ring of complementary shape but reversely arranged to the outer ring. The planar surface of the inner ring is provided with a circumferential land which joins the innermost radial extent thereof for engaging the innermost radial extent of the outer ring to prevent extrusion of the packing element past the extrusion preventing member.

BRIEF DESCRIPTION OF THE DRAWINGS

FIG. 2 is a top, perceptive view of the inner extrusion preventing ring used in the well packer of FIG. 1.

FIG. 3 is a partial, perspective view of the extrusion preventing device showing the outer and the inner split rings.

DESCRIPTION OF THE PREFERRED EMBODIMENT

Figure 1:
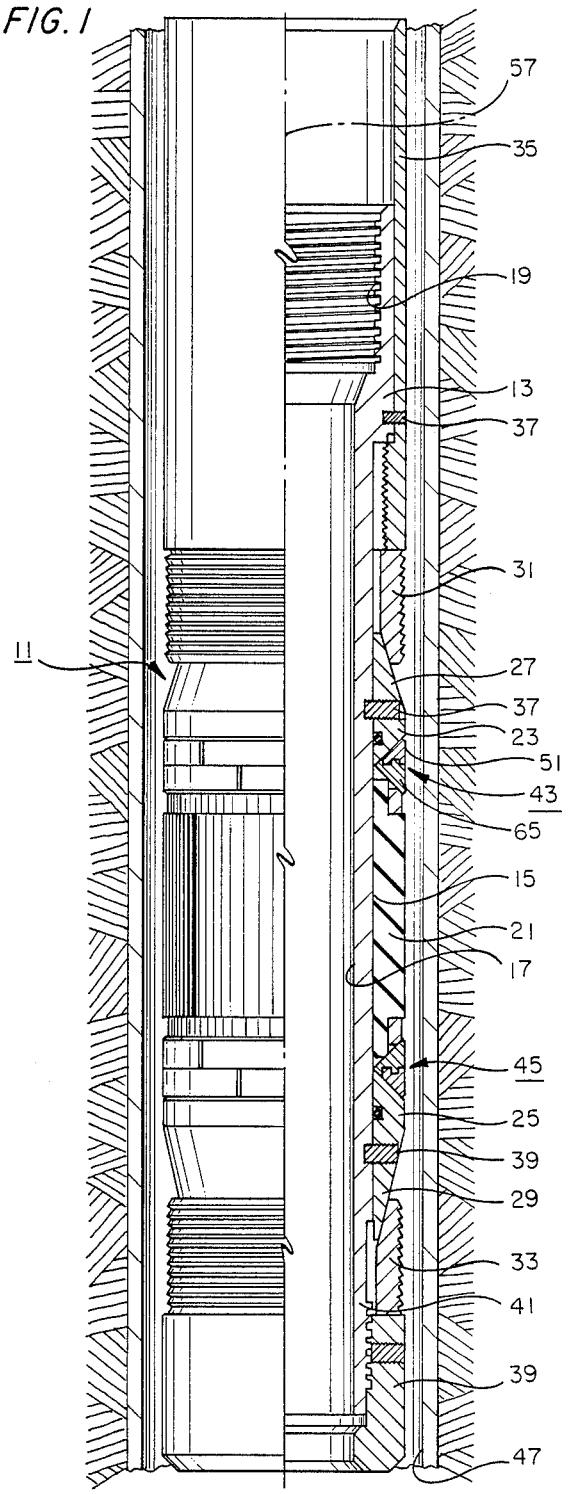
FIG. 1 is a side view, partly in section of the well packer of the invention showing the extrusion preventing rings in the relaxed state.

FIG. 1 shows a well packer of the invention designated generally as 11. The packer includes a tubular mandrel 13 having an exterior 15 and an interior bore 17. The mandrel has upper connecting means such as internal threads 19 for connection to a running tool which forms a part of the well string extending to the well surface. A packer of the general type shown is sold commercially as the Brown Type 2B Permanent Seal Bore Packer and is illustrated on page 30 of the Hughes Production Tools general catalog 1986–1987. A suitable running tool for engaging the internal threads 19 is shown on page 39 of the same catalog.

The packer also has an annular packing element 21 of a resilient, elastomeric type material and upper and lower relatively axially shiftable annular shoulders 23, 25 disposed on opposite sides of the packing element 21.

At least one of the shoulders 23, 25 is movable towards and away from the other shoulder.

In the packer illustrated in FIG. 1, the annular shoulders 23, 25 form a part of the cone elements of the well packer 11, the cone elements having tapered expander surfaces 27, 29 for causing outward radial movement of the serrated slips 31, 33. The lower slip 33 rests upon an end ring 39 which threadedly engages the lower extent 41 of the tubular mandrel 13. A setting sleeve 35 is connected to the running tool. Actuation of the running tool, as will be understood by those skilled in the art, results in relative movement between the setting sleeve 35 and the tubular mandrel 13. This relative movement shears the screws 37, 39, thereby compressing the packing element 21 and allowing the outer radial expansion of the gripping slips 31, 33.

An extrusion preventing device 43, 45 is located between each shoulder 23, 25 and the packing element 21. The extrusion preventing devices are radially expandable into abutment with the inner surface 47 of the outer conduit (casing) upon movement of the first and second shoulders 23, 25 toward each to compress the packing element.

As best seen in FIGS. 2 and 3, each extrusion preventing device 43 includes an outer split ring 49 having a generally triangular cross-section defined by a cylindrical abutment surface 51 for abutment with the inner surface 47 of the outer conduit, a tapered sidewall 53 engageable with one of the shoulders 23, and a planar surface 55 which is substantially normal to the longitudinal axis 57 of the packer. The planar surface 55 has an innermost radial extent 59 which joins the tapered sidewall 53 and an outermost radial extent 61 which joins the cylindrical abutment surface 51.

The extrusion preventing device 43 also includes an inner split ring 63 which is reversely arranged to the outer ring 49. The inner ring 63 also has a generally triangular cross-section defined by a cylindrical abutment surface 65 which is continuous with the surface 51 for abutment with the inner surface 47 of the outer conduit, a tapered sidewall 67 engageable with the packing element 21, and a planar surface 69 having an innermost radial extent 71 which joins the tapered sidewalls 67 and an outermost radial extent 73 which joins the cylindrical abutment surface 65.

The ring planar surfaces 55, 69 are keyed to one another for circumferential sliding movement. Preferably, the ring planar surfaces 55, 69 are keyed by means of a tongue and groove arrangement such as circumferential rib 75 on inner ring 63 and circumferential groove 77 provided in outer ring 49. Thus, although circumferential sliding movement is allowed between the rings 49, 63, relative radial movement therebetween is prevented. The rings are each split at and axial location (79 in FIG. 2) and tend to remain in a retracted position, such as that shown in FIG. 1. The splits in the upper and lower rings 49, 63 are staggered with respect to one another and are preferably displaced approximately 180° from one another when the rings are assembled. Because of the circumferential rib and groove arrangement and because of the split 79, the rings 49, 63 are expandable outwardly to bring their outer cylindrical surfaces 51, 65 into engagement with the cylindrical inner surface 47 of the surrounding conduit.

The extrusion preventing rings of the invention are also provided with a circumferential land 81 which helps to prevent extrusion of the packing element 21 past the rings in use. As viewed in cross-section, the land 81 is provided on the planar surface 69 of the land 81 is provided on the planar surface 69 of the inner split ring 63 and is itself of generally triangular cross-section, extending axially from the planar surface 69 in the direction of the companion shoulder 23. As shown in FIGS. 1 and 3, one surface 83 of the land 81 is tapered to form a continuous surface with the tapered surface 53 of the outer split ring 49 when the rings are assembled. As shown in FIG. 3, the land, together with the circumferential rib 75 forms a channel for receiving a mating portion of the outer ring 49. The channel, indicated generally at 69 in FIG. 3, has a generally rectangular cross-section with a bottom surface and spaced side walls which are parallel and extend axially with respect to the longitudinal axis 57 of the packer. One of the side walls 85 is defined by the circumferential land 81 and the other side wall 87 is defined by the circumferential rib 75.

In operation, the running tool is actuated to cause relative movement between the setting sleeve 35 and the tubular mandrel 13 of the packer. This relative movement shifts the outer parts of the packer to expand the gripping slips 31, 33 radially outward and to expand the packing element 21 and extrusion preventing rings 43, 45 radially outward. As the slips 31, 33 and packing element 21 contact the surrounding casing surface 47, the extrusion preventing rings 43, 45 are also brought into contact with the surrounding casing. The circumferential land 81 seals off against its respective expander shoulder 23, 25 to prevent the extrusion of packing material past the rings. The circumferential land also provides a ring design which rings having a point contact at the innermost radial extents.

An invention has been provided with several advantages. The extrusion preventing rings of the invention are stronger than previous designs and less likely to bend or fail in use. The extrusion preventing rings of the invention are also more effective in preventing extrusion of the packing element past the rings under extreme temperature and pressure conditions such as are encountered during permanent packer use.

While the invention has been shown is only one of its forms, it is not thus limited but is susceptible to various changes and modifications without departing from the spirit thereof.

We claim:

1. A well packer for use in maintaining sealing integrity between inner and outer concentric conduits under downhole temperature and pressure conditions in a subterranean well, the well packer comprising:

a centrally located, tubular mandrel;

an annular packing element carried about said tubular mandrel, which is radially expandable under axial compression;

upper and lower axially shiftable annular shoulders respectively disposed on opposite sides of said packing element on said mandrel, at least one of said shoulders being movable towards and away from the other shoulder;

an extrusion preventing device located between each shoulder and the packing element, each extrusion preventing device being radially expandable into abutment with the inner surface of the outer conduit upon movement of the first and second shoulders toward each other to compress the packing element, each extrusion preventing device including an outer split ring having a generally triangular cross-section defined by a cylindrical abutment surface for abutment with the inner surface of the outer conduit, a tapered sidewall engageable with one of said shoulders, and a planar surface which is substantially normal to the longitudinal axis of the packer, the planar surface having an innermost radial extent which joins said tapered sidewall and an outermost radial extent which joins said cylindrical abutment surface, the extrusion preventing device also including an inner split ring reversely arranged to the outer ring, the inner ring having a generally triangular cross-section defined by a cylindrical abutment surface for abutment with the inner surface of the outer conduit, a tapered sidewall engageable with said packing element, and a planar surface which is substantially normal to the longitudinal axis of the packer, the planar surface having an innermost radial extent which joins said tapered sidewall and an outermost radial extent which joins said cylindrical abutment surface so that the cylindrical abutment surfaces are continuous, the ring planar surfaces being keyed to one another for circumferential sliding movement with respect to one another; and wherein the planar surface of the inner ring is provided with a circumferential land which joins the innermost radial extent thereof for engaging the innermost radial extent of the outer ring to prevent extrusion of the packing element between the mandrel and said extrusion preventing member.

2. The well packer of claim 1, wherein said ring planar surfaces are keyed by means of a circumferential rib on one of said surfaces and a circumferential groove on the other of said surfaces.

3. The well packer of claim 2, wherein each of said split rings has an axial split therein, the axial splits in said rings being staggered with respect to one another, the key and slot arrangements being such that the rings are allowed outward radial expansion in the direction of the outer concentric conduit, axial movement between said rings being prevented.

4. The well packer of claim 3, wherein the circumferential land provided on the planar surface of the inner ring is itself of generally triangular cross-section and forms a protrusion which extends axially from the planar surface in the direction of its associated axially shiftable annular shoulder, one surface of said land being tapered to form a continuous surface with the tapered surface of the outer ring.

5. The well packer of claim 4, wherein the circumferential land provided on the planar surface of the inner ring, together with the circumferential rib provided thereon, forms a channel for receiving a mating portion of the outer ring.

6. The well packer of claim 5, wherein the channel formed on the planar surface of the inner ring has a generally rectangular cross-section defined by a bottom surface and spaced sidewalls, the sidewalls extending axially with respect to the longitudinal axis of the well packer, one of the sidewalls being defined by the circumferential land and the other of the sidewalls being defined by the circumferential rib.

* * * * *